US009569909B2

(12) United States Patent
Xia et al.

(10) Patent No.: US 9,569,909 B2
(45) Date of Patent: Feb. 14, 2017

(54) PORTABLE DRUM-TYPE BANKNOTE BOX AND ATM

(71) Applicant: GRG Banking Equipment Co., Ltd., Guangzhou, Guangdong (CN)

(72) Inventors: Yin Xia, Guangdong (CN); Dong Tan, Guangdong (CN); Zhiqiang Sun, Guangdong (CN); Zhuang Jiang, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 15/024,004

(22) PCT Filed: Nov. 21, 2014

(86) PCT No.: PCT/CN2014/091857
§ 371 (c)(1),
(2) Date: Mar. 22, 2016

(87) PCT Pub. No.: WO2016/000390
PCT Pub. Date: Jan. 7, 2016

(65) Prior Publication Data

US 2016/0240030 A1 Aug. 18, 2016

(30) Foreign Application Priority Data

Jun. 30, 2014 (CN) ..... 2014 1 0309870

(51) Int. Cl.
*G07D 11/00* (2006.01)
*G07D 7/12* (2016.01)

(52) U.S. Cl.
CPC ..... *G07D 11/0009* (2013.01); *G07D 7/12* (2013.01); *G07D 11/00* (2013.01); *G07D 11/0012* (2013.01)

(58) Field of Classification Search
CPC ..... B65H 23/006; B65H 2211/00; B65H 2402/44; B65H 2403/725; B65H 2403/7251; G07D 11/00; G07D 11/0006; G07D 11/0009; G07D 11/0021; G07D 11/0096
(Continued)

(56) References Cited

U.S. PATENT DOCUMENTS 4,363,229 A 12/1982 Baitz
5,509,646 A 4/1996 Chang
(Continued)

FOREIGN PATENT DOCUMENTS

CN 201397533 Y 2/2010
CN 201443259 U 4/2010
(Continued)

OTHER PUBLICATIONS

International Search Report, dated Mar. 20, 2015, from corresponding International Application No. PCT/CN2014/091857, (3 pages).
(Continued)

*Primary Examiner* — Mark Beauchaine
(74) *Attorney, Agent, or Firm* — Wolf, Greenfield & Sacks, P.C.

(57) ABSTRACT

A portable drum-type banknote box and an ATM having the portable drum-type banknote box. The portable drum-type banknote box includes a shell, a large winding drum gear, a small winding drum gear, a connecting socket and a self-locking mechanism. The self-locking mechanism includes an electromagnet, a first spring, a second spring, a first locking rod, a second locking rod and a pull rod. The upper end of the pull rod is installed to the electromagnet in a paired mode, and the lower end of the pull rod is movably connected with the first locking rod. The portable drum-type banknote box has a small size and light weight, is convenient
(Continued)

to assemble/disassemble and move and is capable of performing audit work on multiple ATMs; and achieves a locking function so as to effectively prevent the banknotes from being exposed and rolled out by human.

20 Claims, 7 Drawing Sheets

(58) Field of Classification Search
USPC ..... 194/207; 242/156, 382.5, 421
See application file for complete search history.

(56) References Cited

U.S. PATENT DOCUMENTS

| | | | | |
|---|---|---|---|---|
| 2001/0034202 | A1 | 10/2001 | Nottingham et al. | |
| 2003/0116400 | A1* | 6/2003 | Saltsov | B65H 29/006 194/207 |
| 2010/0168903 | A1* | 7/2010 | Aas | G07D 11/0009 700/214 |

FOREIGN PATENT DOCUMENTS

| | | | |
|---|---|---|---|
| CN | 101806180 | A | 8/2010 |
| CN | 102930638 | A | 2/2013 |
| CN | 103410402 | A | 11/2013 |
| CN | 103617675 | A | 3/2014 |
| CN | 104036587 | A | 9/2014 |
| EP | 0014856 | A1 | 9/1980 |
| EP | 0136372 | A1 | 4/1985 |
| EP | 2922038 | A1 | 9/2015 |
| KR | 20120088101 | A | 8/2012 |

OTHER PUBLICATIONS

Written Opinion, dated Apr. 1, 2015, from corresponding International Application No. PCT/CN2014/091857 (6 pages).

* cited by examiner

PORTABLE DRUM-TYPE BANKNOTE BOX AND ATM

This application is the national phase of International Application No. PCT/CN2014/091857, titled "PORTABLE DRUM-TYPE BANKNOTE BOX AND ATM", filed on Nov. 21, 2014, which claims priority to Chinese Patent Application No. 201410309870.7 titled "PORTABLE DRUM-TYPE CASHBOX AND ATM", filed with the Chinese State Intellectual Property Office on Jun. 30, 2014, the entire disclosures of both applications are incorporated herein by reference to the maximum extent allowable by law.

FIELD

The present application relates to the field of financial apparatus, and particularly to a portable drum-type cashbox and an ATM.

BACKGROUND

With the development of the market, the demand from banks and customers on functions of an automated teller machine (ATM) has been increased, and with the additional functions, the market competitiveness of the ATM is also increased.

Currently, a cashbox device in an ATM is mounted inside the ATM, and is capable of performing audit and clearing to banknotes in the ATM.

However, a power device (motor) of a conventional cashbox device is arranged inside the cashbox device, which makes the cashbox device have a relatively large volume and a relatively great weight, and it is not convenient to mount and dismount and move the cashbox device, also it cannot perform audit on multiple ATMs. In addition, a winding drum gear of the cashbox device does not have a locking function, and when the banknotes on a winding drum are exposed, a situation that the banknotes in the cashbox device are rolled out is apt to occur.

SUMMARY

A portable drum-type cashbox and an ATM are provided according to embodiments of the present application, which allows the cashbox device to have a reduced volume and a reduced weight, to be conveniently mounted, dismounted and moved, and allows the cashbox device to perform audit on multiple ATMs; and the cashbox device has a locking function, which may effectively prevent the banknotes from being exposed, and prevent the banknotes from being rolled out by human.

A portable drum-type cashbox according to the present application includes: a housing; a large winding drum gear, a small winding drum gear, a connecting socket, and a self-locking mechanism;

the self-locking mechanism includes: an electromagnet, a first spring, a second spring, a first locking rod, a second locking rod, and a pull rod;

the pull rod has an upper end mounted cooperatively with the electromagnet, and a lower end movably connected to the first locking rod;

the first spring has one end fixedly connected to the housing, and another end fixedly connected to the first locking rod;

the second spring has one end fixedly connected to the housing, and another end fixedly connected to the second locking rod;

the first locking rod is connected to the second locking rod via a rotary shaft;

the first locking rod is provided with a toothed portion configured to engage with teeth of the small winding drum gear; and the second locking rod is provided with a toothed portion configured to engage with teeth of the large winding drum gear.

Optionally, the first locking rod is movably connected to the second locking rod via the rotary shaft; and in the case that the first locking rod rotates about the rotary shaft by a preset angle, the first locking rod is engaged with the second locking rod; and in the case that the first locking rod rotates about the rotary shaft by two times of the preset angle, the first locking rod drives the second locking rod to rotate about the rotary shaft by the preset angle.

Optionally, The portable drum-type cashbox further includes an unlocking rod; and the unlocking rod is movably mounted at a mounting point in the housing, and has one end movably connected to the pull rod.

Optionally, in the case that the unlocking rod is pulled, the unlocking rod rotates about the mounting point by a certain angle, and drives the pull rod to move upwards by a certain distance.

Optionally, the portable drum-type cashbox further includes a photoelectric sensor; and the photoelectric sensor is configured to detect the position of the pull rod.

Optionally, the housing includes: a left shell, a right shell, a front door, a side door, a door lock, a drum box handle, a banknote passage and a gear; and a toothed edge at one side of the gear is engaged with the small winding drum gear, and a toothed edge at another side of the gear is configured to engage with a transmission gear of the ATM; and the transmission gear of the ATM is configured to be matched with the gear.

An ATM according to embodiments of the present application includes: a cashbox power device and the portable drum-type cashbox;

the cashbox power device includes: a large-winding-drum power motor, a small-winding-drum power motor and a frame;

the large-winding-drum power motor is fixed inside the frame, and is connected to the large winding drum gear of the portable drum-type cashbox via a synchronous belt;

the small-winding-drum power motor is fixed inside the frame, and is configured to engage with the gear of the portable drum-type cashbox via a transmission gear; and the transmission gear is mounted onto the frame.

Optionally, the ATM further includes:

a banknote entrance module, an upper-portion upper passage module, an upper-portion lower passage module, a banknote identification module, a lower-portion passage module, several upper drum-type cashboxes; and several lower drum-type cashboxes;

the banknote entrance module is mounted at a position of a banknote entrance of the ATM, and is used for banknote feeding, banknote counting, and banknote dispensing of the ATM;

the upper-portion upper passage module is mounted at an upper portion of the ATM, and is configured to provide a conveying passage for banknotes in an upper side of the upper portion of the ATM;

the upper-portion lower passage module is mounted at the upper portion of the ATM, and is configured to provide a conveying passage for banknotes in a lower side of the upper portion of the ATM;

the banknote identification module is mounted at the upper portion of the ATM, and is configured to identify banknotes and count banknotes;

the lower-portion passage module is mounted at a lower portion of the ATM, and is configured to provide a conveying passage for banknotes in the lower portion of the ATM;

the upper drum-type cashboxes are mounted at an upper side of the lower portion of the ATM, and are configured to store banknotes; and the lower drum-type cashboxes are mounted at a lower side of the lower portion of the ATM, and are configured to store banknotes.

Optionally, the ATM further includes:

a first reversing mechanism, a second reversing mechanism, and a third reversing mechanism;

the first reversing mechanism is configured to switch a conveying direction of banknotes at a junction of the upper-portion upper passage module, the upper-portion lower passage module, and the lower-portion passage module;

the second reversing mechanism is configured to switch the conveying direction of banknotes at a junction of the upper-portion upper passage module and the upper-portion lower passage module; and the third reversing mechanism is configured to switch the conveying direction of banknotes between passage branches inside the upper-portion upper passage module.

Optionally, banknotes in the several upper drum-type cashboxes and/or the several lower drum-type cashboxes are configured to enter into the portable drum-type cashbox with the assistance of the lower-portion passage module, the first reversing mechanism, the banknote identification module, the upper-portion lower passage module, the upper-portion upper passage module, the third reversing mechanism or the second reversing mechanism, to be audited, and to return into the several upper drum-type cashboxes and/or the several lower drum-type cashboxes. According to the above technical solutions, the embodiments of the present application have the following advantages.

In the embodiments of the present application, the portable drum-type cashbox includes the housing, the large winding drum gear, the small winding drum gear, the connecting socket, and the self-locking mechanism. The self-locking mechanism includes the electromagnet, the first spring, the second spring, the first locking rod, the second locking rod, and the pull rod. The pull rod has an upper end mounted cooperatively with the electromagnet, and a lower end movably connected to the first locking rod. The first spring has one end fixedly connected to the housing, and another end fixedly connected to the first locking rod. The second spring has one end fixedly connected to the housing, and another end fixedly connected to the second locking rod. The first locking rod is connected to the second locking rod via a rotary shaft. The first locking rod is provided with the toothed portion configured to engage with the teeth of the small winding drum gear. The second locking rod is provided with the toothed portion configured to engage with the teeth of the large winding drum gear. In this embodiment, there is no power device (motor) inside the portable drum-type cashbox, thus the cashbox has a reduced volume and a reduced weight, and is convenient to be mounted, dismounted and moved, hence the portable drum-type cashbox may be dismounted and mounted to perform audit on multiple ATMs. Also, the portable drum-type cashbox has the self-locking mechanism, and may achieve the locking function by several components including the electromagnet, the first spring, the second spring, the first locking rod, the second locking rod and the pull rod, and may effectively prevent the situations that the banknotes are exposed and the banknotes are rolled out by human.

DETAILED DESCRIPTION

A portable drum-type cashbox and an ATM are provided according to embodiments of the present application, which allows the cashbox device to have a reduced volume and a reduced weight, to be conveniently mounted, dismounted and moved, and allows the cashbox device to perform audit on multiple ATMs; and the cashbox device has a locking function, which may effectively prevent the banknotes from being exposed, and prevent the banknotes from being rolled out by human.

For making the objects, features and advantages of the present application clearer and easier to be understood, the technical solutions according to embodiments of the present application are described clearly and completely hereinafter in conjunction with the drawings in the embodiments of the present application. Apparently, the embodiments described hereinafter are only a part of the embodiments of the present application, rather than all embodiments. Based on the embodiments in the present application, all of other embodiments, made by the person skilled in the art without any creative efforts, fall into the scope of the present application.

Figure 1:
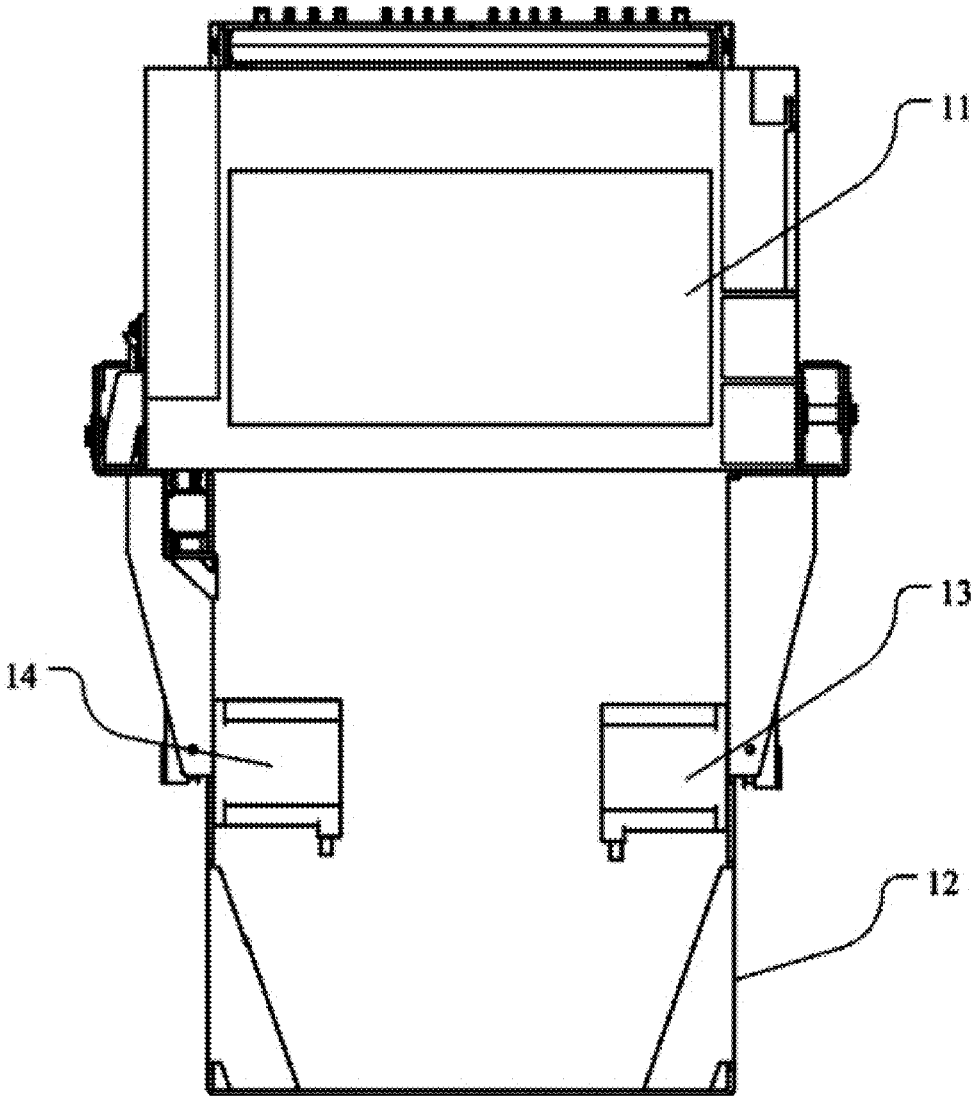
FIG. 1 is a view showing an integral structure of a portable drum-type cashbox and a cashbox power device in an ATM according to an embodiment of the present application.

Referring to FIG. 1, an embodiment of a portable drum-type cashbox according to the present application includes a housing 42, a large winding drum gear 36, a small winding drum gear 35, a connecting socket 38, and a self-locking mechanism.

The self-locking mechanism includes an electromagnet 34, a spring 40, a spring 41, a locking rod 30, a locking rod 31, and a pull rod 33.

The pull rod 33 has an upper end mounted cooperatively with the electromagnet 34, and a lower end movably connected to the locking rod 30.

The spring 40 has one end fixedly connected to the housing 42, and another end fixedly connected to the locking rod 30.

The spring 41 has one end fixedly connected to the housing 42, and another end fixedly connected to the locking rod 31.

The locking rod 30 is connected to the locking rod 31 via a rotary shaft 32.

The locking rod 30 is provided with a toothed portion configured to engage with teeth of the small winding drum gear 35.

The locking rod 31 is provided with a toothed portion configured to engage with teeth of the large winding drum gear 36.

It is to be noted that, preferably, the locking rod 30 is movable connected to the locking rod 31 via the rotary shaft 32; and in the case that the locking rod 30 rotates about the rotary shaft 32 by a preset angle, the locking rod 30 is engaged with the locking rod 31; and in the case that the locking rod 30 rotates about the rotary shaft 32 by two times of the preset angle, the locking rod 30 drives the locking rod 31 to rotate about the rotary shaft 32 by the preset angle. This arrangement may achieve that when the locking rod 30 rotates by the preset angle, the locking rod 31 is not moved, and in this case, the small winding drum gear 35 has been released, however the large winding drum gear 36 is still in a locked state, hence, the small winding drum gear 35 and the large winding drum gear 36 may be observed and tested separately, which facilitates the pre-test and post-maintenance to the portable drum-type cashbox by an operator.

The portable drum-type cashbox according to the embodiment of the present application may further include an unlocking rod 37.

The unlocking rod 37 is movably mounted at a mounting point 43 in the housing 42, and one end of the unlocking rod 37 is movably connected to the pull rod 33. In the case that the unlocking rod 37 is pulled, the unlocking rod 37 rotates about the mounting point 43 by a certain angle, and drives the pull rod 33 to move upwards by a certain distance. It may be appreciated that, another end of the unlocking rod 37 may be disposed behind a front door 23, and the front door 23 is locked by a door lock 26, thereby ensuring that the operation of the unlocking rod 37 can only be performed by an authorized person (having a key of the door lock 26). When the authorized person needs to operate the unlocking rod 37, he needs to unlock the door lock 26, and then open the front door to operate the unlocking rod 37.

The portable drum-type cashbox according to the embodiment of the present application may include a photoelectric sensor 39.

The photoelectric sensor 39 is configured to detect the position of the pull rod 33. It can be understood that, in the case that the portable drum-type cashbox is mounted in the ATM, the photoelectric sensor 39 is communicatively connected to a background controller of the ATM. The photoelectric sensor 39 transmits position information of the pull rod 33 to the background controller, and the background controller may perform an operation accordingly according to the position of the pull rod 33. For example, only when the position of the pull rod 33 is moved upwards sufficiently (i.e., the pull rod 33 is moved upwards by a sufficient distance, to allow both of the small winding drum gear 35 and the large winding drum gear 36 to be unlocked), the background controller can control the power motor in the cashbox power device of the ATM to start, thereby driving the small winding drum gear 35 and the large winding drum gear 36 to rotate.

Figure 3:
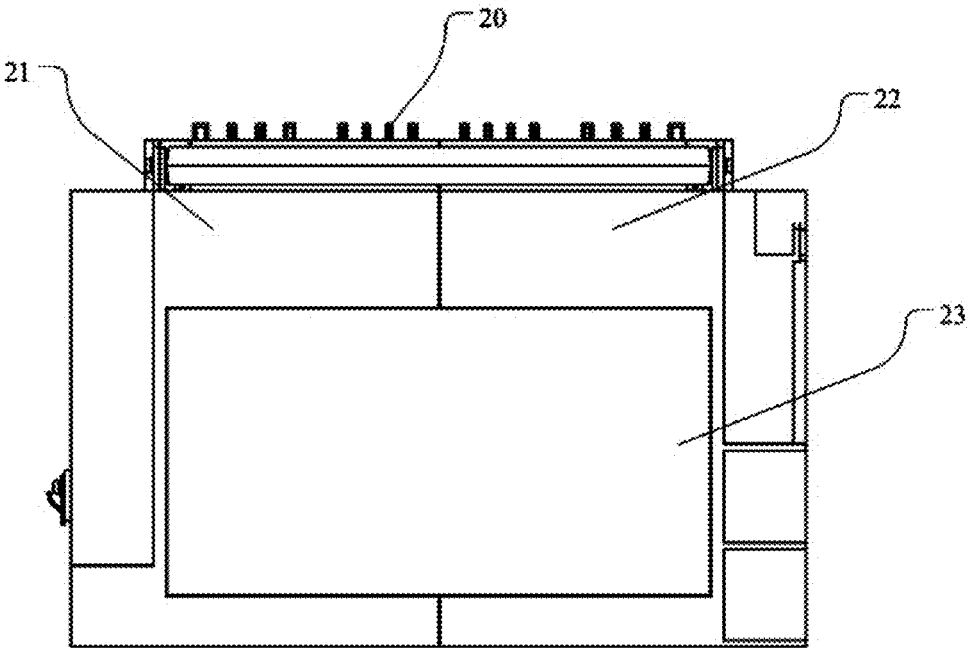
FIG. 3 is a front view showing an external structure of a portable drum-type cashbox according to an embodiment of the present application.
Figure 4:
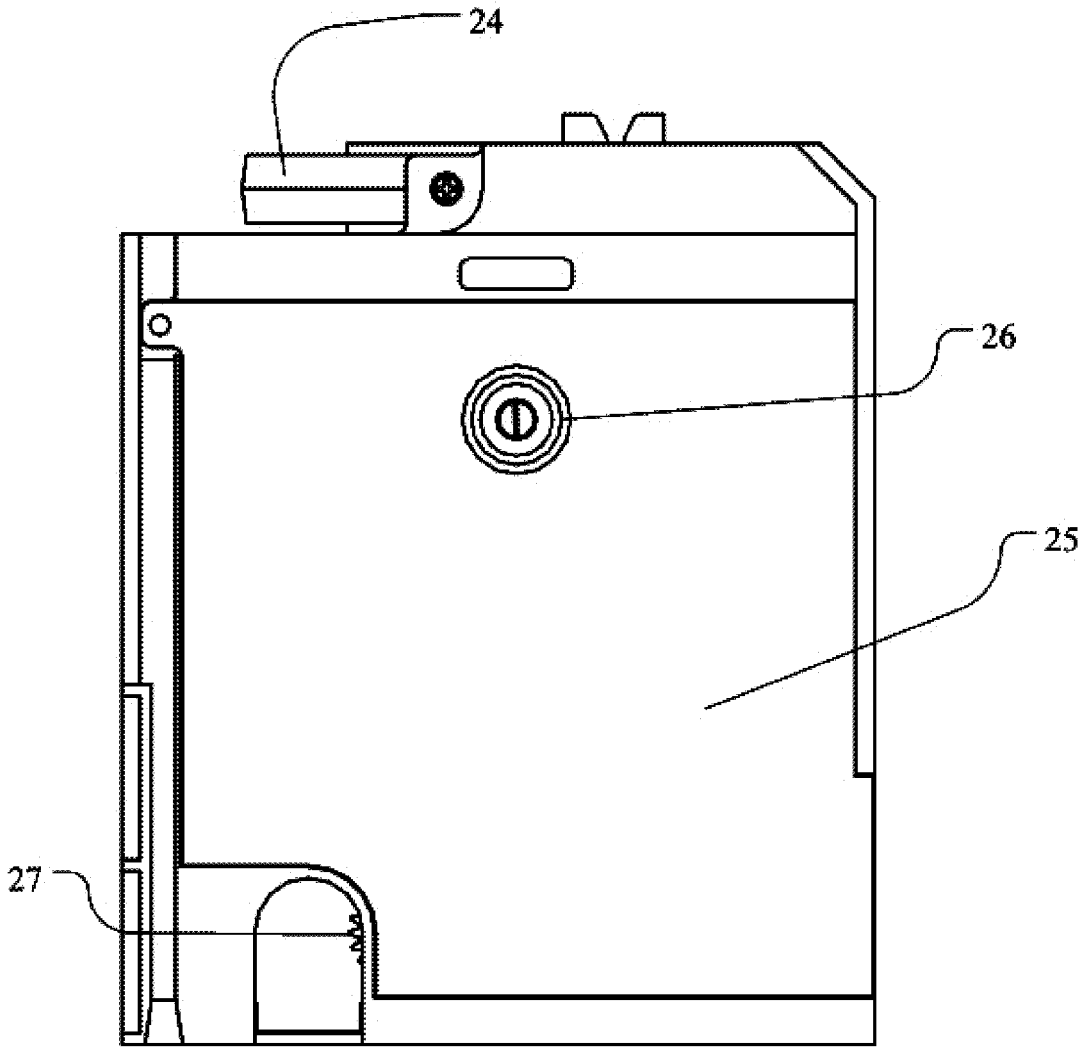
FIG. 4 is a side view showing the external structure of the portable drum-type cashbox according to the embodiment of the present application.

The housing 42 according to an embodiment of the present application may include a left shell 21, a right shell 22, the front door 23, a side door 25, the door lock 26, a drum box handle 24, a banknote passage 20 and a gear 27, as shown in FIGS. 3 and 4.

Figure 7:
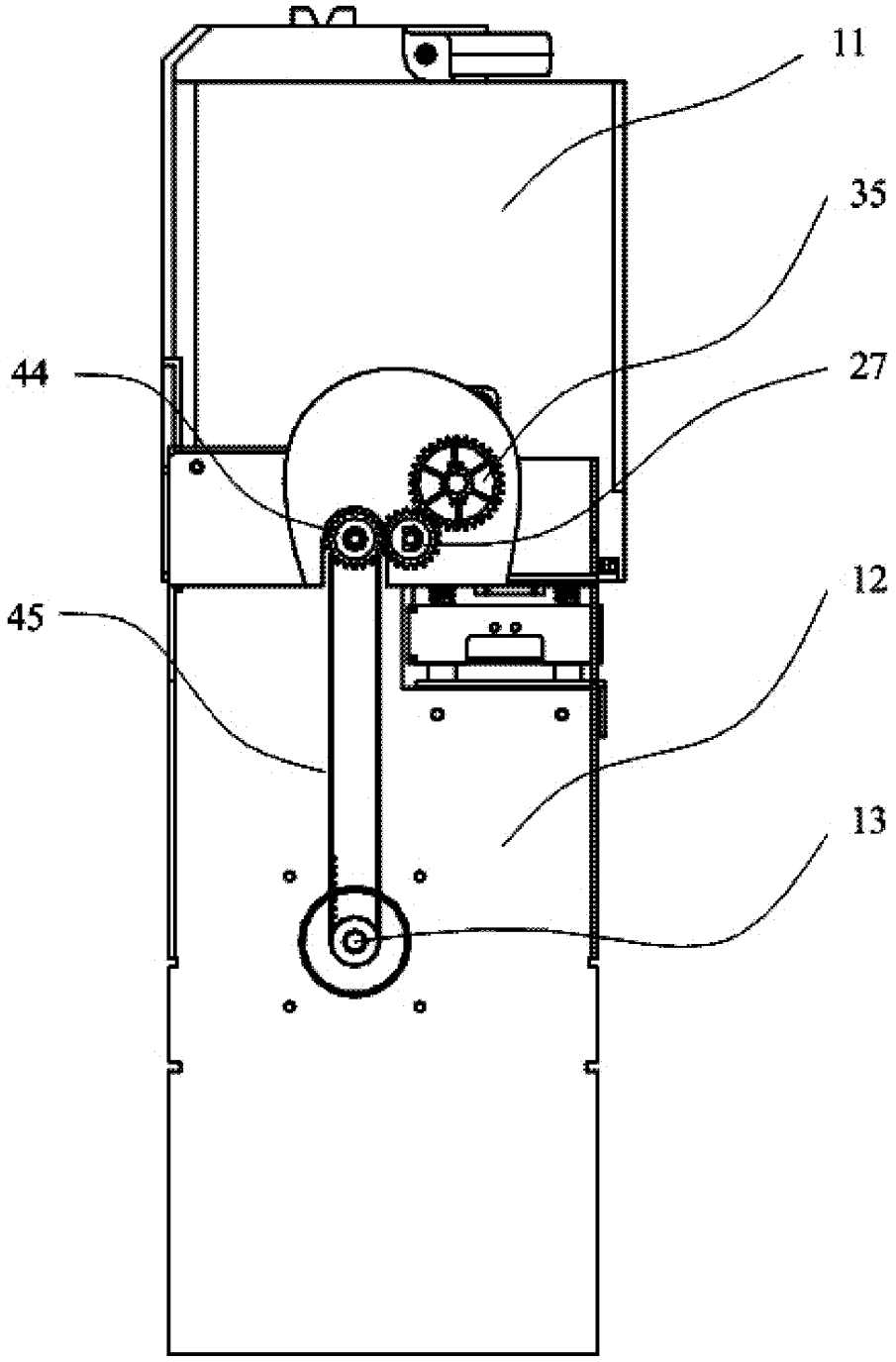
FIG. 7 is a partially sectional view of FIG. 2.

A toothed edge at one side of the gear 27 and the small winding drum gear 35 are engaged with each other, and a toothed edge at another side of the gear 27 and a transmission gear 44 of the ATM are engaged with each other. The transmission gear 44 of the ATM is arranged to match with the gear 27, as shown in FIG. 7.

Reference is made to FIGS. 3 and 4, which are schematic views showing an external structure of the portable drum-type cashbox. The portable drum-type cashbox is enclosed by the left shell 21 and the right shell 22, and the side door 25 and the front door 23 may be opened by the door lock 26 to perform maintenance within the cashbox. The drum box handle 24 makes it easy for the operator to take out and carry the cashbox. In addition, the banknote passage 20 located at the top of the cashbox and the gear 27 configured to engage with the transmission gear 44 of the ATM are further provided.

Figure 5:
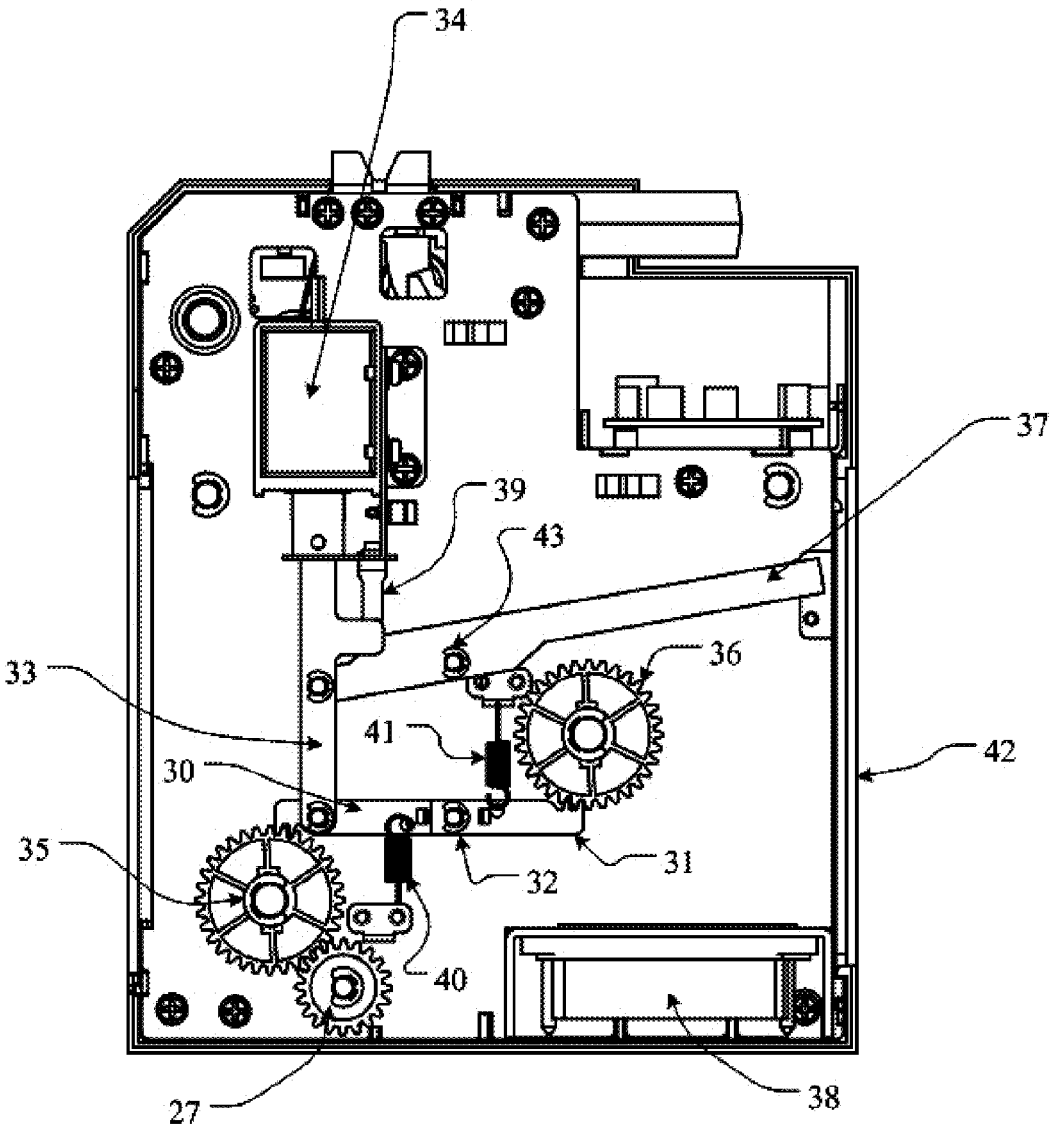
FIG. 5 is a schematic view showing an internal structure of the portable drum-type cashbox according to the embodiment of the present application.

Reference is made to FIG. 5, which is a schematic view showing the internal structure of the portable drum-type cashbox. The specific operation process may be performed as follows. When the portable drum-type cashbox is installed in the ATM, the connecting socket 38 is turned on, and the electromagnet 34 is controlled to be energized to generate an attracting force, to pull the pull rod 33 to move upwards by a certain distance, and the distance is controlled by the photoelectric sensor 39, and thus the locking rod 30 rotates clockwise about the rotary shaft 32 against the tensile force of the spring 40. When the locking rod 30 rotates to an angle θ, a toothed portion at a front end of the locking rod 30 is disengaged from the small winding drum gear 35, and a toothed portion at a front end of the locking rod 31 at this time still locks the large winding drum gear 36. When the locking rod 30 continues to rotate to an angle 2 θ, a tail end of the locking rod 30 will push the locking rod 31 to rotate clockwise to an angle θ, and at this time, the toothed portion at the front end of the locking rod 31 is disengaged from the large winding drum gear 36, in this way, the large winding drum and the small winding drum can operate normally. When the portable drum-type cashbox is taken out from the ATM, the connecting socket 38 is disconnected, and the electromagnet 34 is de-energized and does not generate an attracting force. Under the action of the spring 40 and the spring 41, the toothed portion at the front end of the locking rod 30 and the toothed portion at the front end of the locking rod 31 are respectively engaged into the teeth of the small winding drum gear 35 and the teeth of the large winding drum gear 36, thus the large winding drum and the small winding drum are locked to be prevented from rotating in one rotational direction, and since the large winding drum and the small winding drum are connected by a tape, the large winding drum and the small winding drum are also prevented from rotating in another rotational direction. In this way, it can avoid situations such as loosening of the tape and scattering of banknotes on the winding drums when the winding drums are rotating in a free state, and also avoid a safety issue that banknotes in the cashbox may be rolled out when a person rotates the external gear. When the inside of the portable drum-type cashbox is required to be maintained by an operator, the unlocking rod 37 is pulled to move the pull rod 33 upwards, which may also allow the teeth at two ends of the locking rod 30 and the locking rod 31 to be disengaged from the small winding drum gear 35 and the large winding drum gear 36 respectively. In this way, the large winding drum and the small winding drum may be rotated by a handle wheel at another side to perform maintenance.

In this embodiment, the portable drum-type cashbox includes the housing 42, the large winding drum gear 36, the small winding drum gear 35, the connecting socket 38, and the self-locking mechanism. The self-locking mechanism includes the electromagnet 34, the spring 40, the spring 41, the locking rod 30, the locking rod 31, and the pull rod 33. The pull rod 33 has an upper end mounted cooperatively with the electromagnet 34, and a lower end movably connected to the locking rod 30. The spring 40 has one end fixedly connected to the housing 42, and another end fixedly connected to the locking rod 30. The spring 41 has one end fixedly connected to the housing 42, and another end fixedly connected to the locking rod 31. The locking rod 30 is connected to the locking rod 31 via a rotary shaft 32. The locking rod 30 is provided with the toothed portion configured to engage with the teeth of the small winding drum gear 35. The locking rod 31 is provided with the toothed portion configured to engage with the teeth of the large winding drum gear 36. In this embodiment, there is no power device (motor) inside the portable drum-type cashbox, thus the cashbox has a reduced volume and a reduced weight, and is convenient to be mounted, dismounted and moved, hence the portable drum-type cashbox may be dismounted and mounted to perform audit on multiple ATMs. Also, the portable drum-type cashbox has the self-locking mechanism, and may achieve the locking function by several components including the electromagnet 34, the spring 40, the spring 41, the locking rod 30, the locking rod 31 and the pull rod 33, and may effectively prevent the situations that the banknotes are exposed and the banknotes are rolled out by human.

The portable drum-type cashbox is mainly described hereinbefore, and an ATM will be described in detail hereinafter, reference is made to FIGS. 1, 2 and 6, an embodiment of the ATM according to the present application includes a cashbox power device, and a portable drum-type cashbox in embodiments corresponding to FIGS. 3 to 5.

The cashbox power device includes a large-winding-drum power motor 13, a small-winding-drum power motor 14 and a frame 12.

The large-winding-drum power motor 13 is fixed inside the frame 12, and is connected to the large winding drum gear 36 of the portable drum-type cashbox via a synchronous belt 45.

The small-winding-drum power motor 14 is fixed inside the frame 12, and is engaged with the gear 27 of the portable drum-type cashbox via a transmission gear 44.

The transmission gear 44 is mounted onto the frame 12.

In this embodiment, the ATM may further include a banknote entrance module 101, an upper-portion upper passage module 102, an upper-portion lower passage module 103, a banknote identification module 104, a lower-portion passage module 105, several upper drum-type cashboxes 106 and several lower drum-type cashboxes 107.

The banknote entrance module 101 is mounted at a position of a banknote entrance of the ATM, and is used for banknote feeding, banknote counting, and banknote dispensing of the ATM.

The upper-portion upper passage module 102 is mounted at an upper portion of the ATM, and is configured to provide a conveying passage for banknotes in an upper side of the upper portion of the ATM.

The upper-portion lower passage module 103 is mounted at the upper portion of the ATM, and is configured to provide a conveying passage for banknotes in a lower side of the upper portion of the ATM.

The banknote identification module 104 is mounted at the upper portion of the ATM, and is configured to identify banknotes and count banknotes.

The lower-portion passage module 105 is mounted at a lower portion of the ATM, and is configured to provide a conveying passage for banknotes at the lower portion of the ATM.

The upper drum-type cashboxes 106 are mounted at an upper side of the lower portion of the ATM, and are configured to store banknotes.

The lower drum-type cashboxes 107 are mounted at a lower side of the lower portion of the ATM, and are configured to store banknotes.

The ATM in this embodiment may further include a first reversing mechanism 108, a second reversing mechanism 109, and a third reversing mechanism 110.

The first reversing mechanism 108 is configured to switch a conveying direction of banknotes at a junction of the upper-portion upper passage module 102, the upper-portion lower passage module 103, and the lower-portion passage module 105.

The second reversing mechanism 109 is configured to switch a conveying direction of banknotes at a junction of the upper-portion upper passage module 102 and the upper-portion lower passage module 103.

The third reversing mechanism 110 is configured to switch a conveying direction of banknotes between passage branches inside the upper-portion upper passage module 102.

With the assistance of the lower-portion passage module 105, the first reversing mechanism 108, the banknote identification module 104, the upper-portion lower passage module 103, the upper-portion upper passage module 102, the third reversing mechanism 110 or the second reversing mechanism 109, banknotes in the several upper drum-type cashboxes 106 and/or the several lower drum-type cashboxes 107 enter into the portable drum-type cashbox to be audited, and then return to the several upper drum-type cashboxes 106 and/or the several lower drum-type cashboxes 107.

Figure 6:
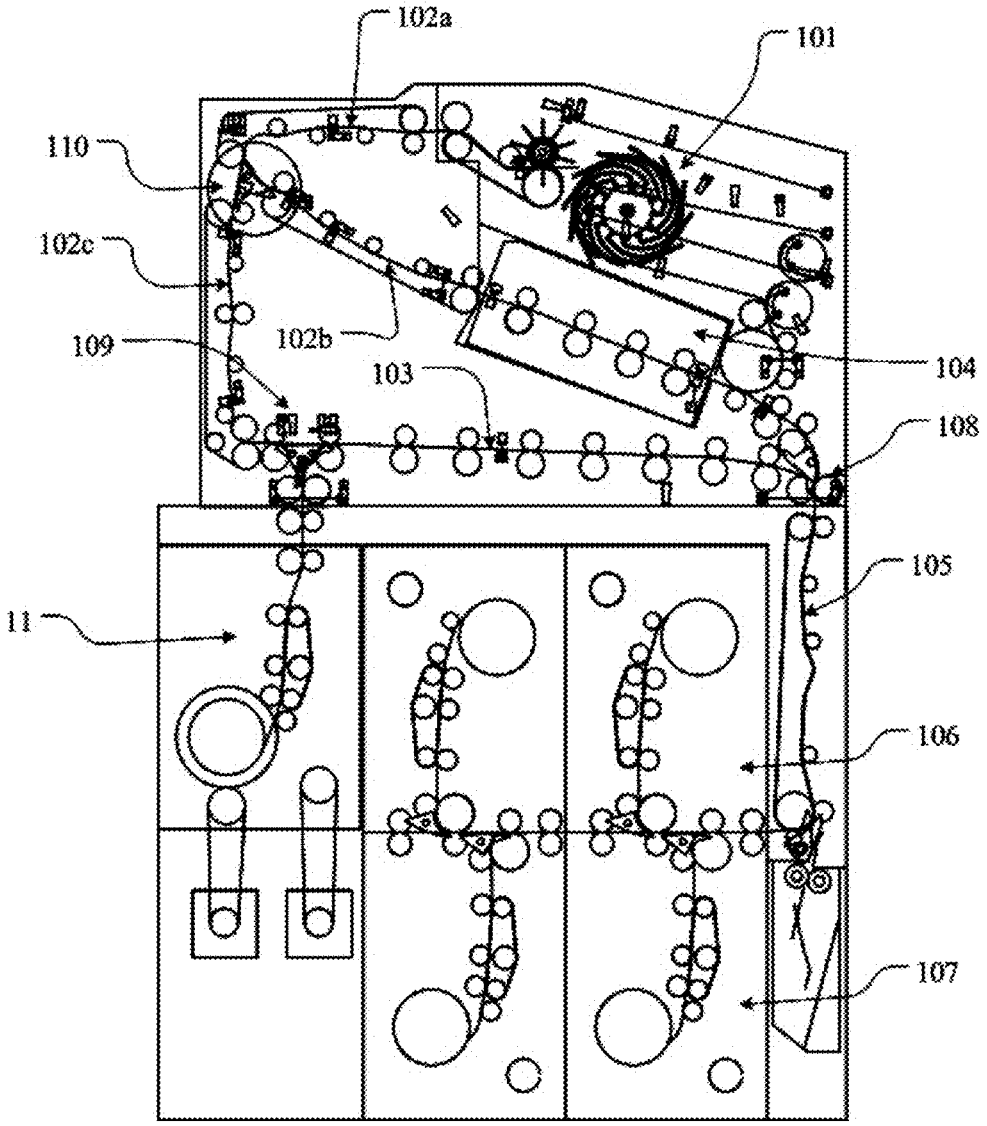
FIG. 6 is a schematic view showing an internal structure of an ATM according to a embodiment of the present application.

Referring to FIG. 6, a conveying path of the banknotes in the ATM when performing the audit operation is described as follows.

To perform audit operation to banknotes in the upper drum-type cashboxes 106 and/or the lower drum-type cashboxes 107, the banknotes may be transferred from the upper drum-type cashboxes 106 or the lower drum-type cashboxes 107 to the lower-portion passage module 105 via a straight middle passage, and then to an upper region of the ATM, and the banknotes pass through the first reversing mechanism 108, and then are identified and counted by the banknote identification module 104, and finally pass through an upper passage 102*b* of the upper-portion upper passage module 102, and enter into a passage 102*c* via the third reversing mechanism 110, and then the banknotes enter into the portable drum-type cashbox from the passage 102*c* via the second reversing mechanism 109. When the audit on one of the drum-type cashboxes (one of the upper drum-type cashboxes 106 or one of the lower drum-type cashboxes 107) is finished, the banknotes come out of the portable drum-type cashbox, and by means of the second reversing mechanism 109, the banknotes enter into the lower-portion passage module 105 through the upper-portion lower passage module 103, and return to the upper drum-type cashbox 106 or the lower drum-type cashbox 107 through the lower-portion passage module 105.

Figure 2:
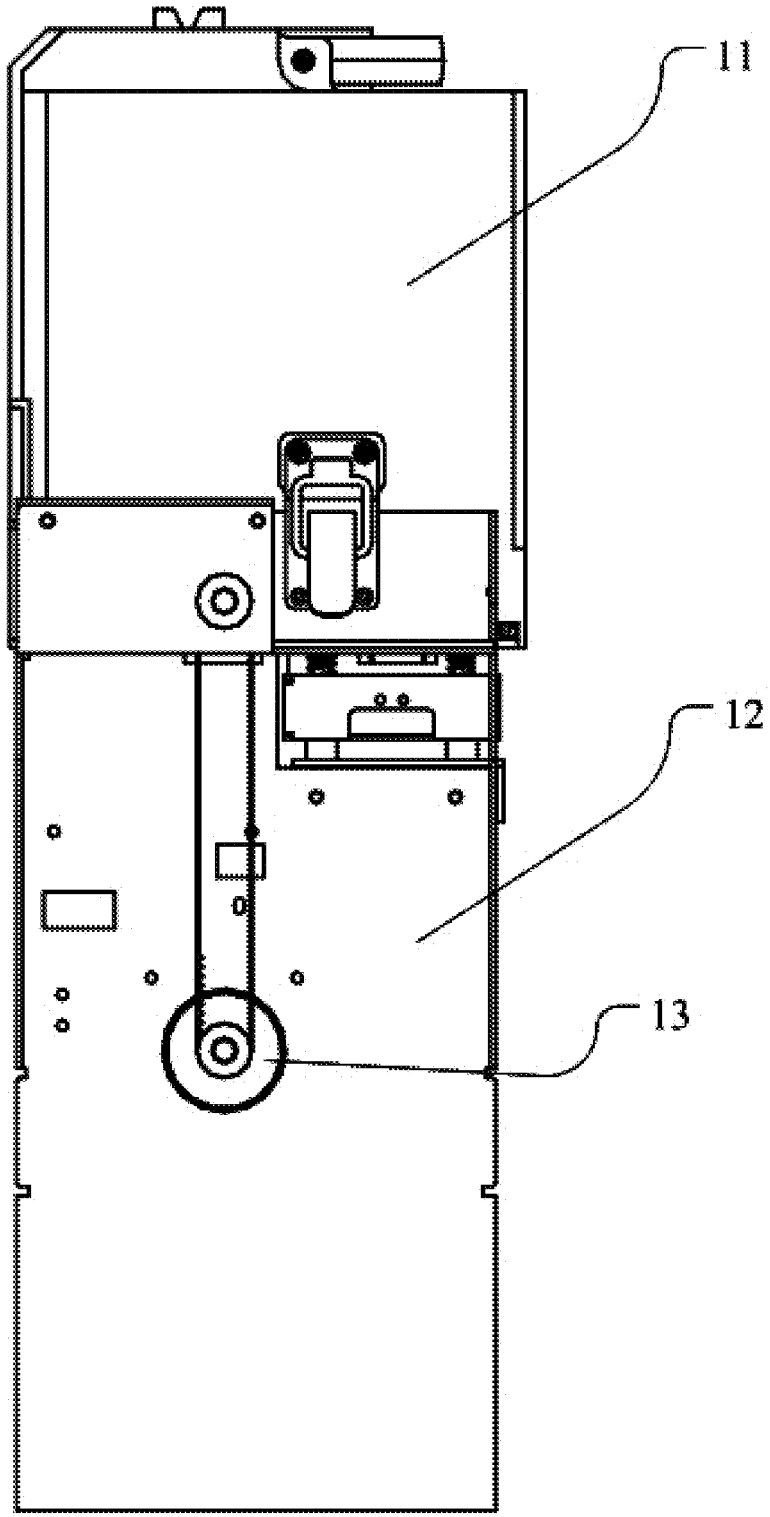
FIG. 2 is a side view of FIG. 1.

Reference is made to FIGS. 1, 2 and 7, which show an integral structure of the cashbox power device and the portable drum-type cashbox. The portable drum-type cashbox is fixedly disposed on the frame 12, and the large-winding-drum power motor 13 and the small-winding-drum power motor 14 are each fixed to the frame 12, power is transmitted to the portable drum-type cashbox through transmission by the synchronous belt 45 and the transmission gear 44, and the synchronous belt 45 and the transmission gear 44 are shown in FIG. 7.

It can be clearly understood by the person skilled in the art that, for convenience and concise of the description, the specific working process of the system, device, and unit described above may refer to the corresponding process in the embodiment of the method described above, which will not be described herein again.

In the several embodiments provided by the present application, it should be appreciated that, the system, the device and the method disclosed herein may be implemented in other manners. For example, the embodiments of the device described above are only schematic. For example, the division of the units is only a division on logical function, and there may be other division modes in the practical implementation, for instance, multiple units or components may be combined, or may be integrated into another system; and some features may be omitted or unperformed. In addition, the coupling, direct coupling or communication connection between the components displayed or discussed above may be realized by some interfaces. The indirect coupling or communication connection between the devices or units may be electrical, mechanical or other forms.

The above unit described as a separate component may be or may be not separated physically. The component displayed as a unit may be or may be not a physical unit, that is, may be located at one place or may be distributed on multiple network units. The object of the solution of the embodiment may be achieved by selecting a part or all of the units according to the practical needs.

Furthermore, various function units in the embodiments of the present application may be integrated in one processing unit; or, each of the function units may be a single physical presence; or two or more function units are integrated in one unit. The above integrated unit may be realized in a form of hardware or in a form of software function unit.

In the case that the integrated unit is implemented in the form of software functional unit and is sold or used as a separate product, it can also be stored in a computer readable storage medium. Based on such understanding, the essence or the part that contributes to the conventional technology of the technical solutions of the present application or a part or whole of the technical solutions may be expressed in the form of a software product. The computer software product is stored in a storage medium, and includes several instructions which enables a computer device (which may be a personal computer, a server, or a network device, and etc.) to execute all or part of the steps of the method of each embodiment of the present application. The storage medium described above includes various medium capable of storing program codes, such as a USB flash disk, a movable hard disk, a Read-Only Memory (ROM), a Random Access Memory (RAM), a magnetic disc or an optical disc.

The above description and the above embodiments only intend to illustrate the technical solutions of the present application, and are not intended to limit the technical solutions of the present application. Though the present application has been described in detail with reference to the above embodiments, it should be understood by the person skilled in the art that, modifications may be made to the technical solutions described in the various embodiments described above, or equivalent substitutions may be made to a part of the technical features in the above embodiments; and all these modifications or substitutions do not make the essence of the respective technical solutions depart from the spirit and scope of the technical solutions of the embodiments of the present application.

The invention claimed is:

1. A portable drum-type cashbox, comprising: a housing; a large winding drum gear, a small winding drum gear, a connecting socket, and a self-locking mechanism; wherein, the self-locking mechanism comprises: an electromagnet, a first spring, a second spring, a first locking rod, a second locking rod, and a pull rod;

the pull rod has an upper end mounted cooperatively with the electromagnet, and a lower end movably connected to the first locking rod;

the first spring has one end fixedly connected to the housing, and another end fixedly connected to the first locking rod;

the second spring has one end fixedly connected to the housing, and another end fixedly connected to the second locking rod;

the first locking rod is connected to the second locking rod via a rotary shaft;

the first locking rod is provided with a toothed portion configured to engage with teeth of the small winding drum gear; and the second locking rod is provided with a toothed portion configured to engage with teeth of the large winding drum gear.

2. The portable drum-type cashbox according to claim 1, wherein, the first locking rod is movably connected to the second locking rod via the rotary shaft; and in the case that the first locking rod rotates about the rotary shaft by a preset angle, the first locking rod is engaged with the second locking rod; and in the case that the first locking rod rotates about the rotary shaft by two times of the preset angle, the first locking rod drives the second locking rod to rotate about the rotary shaft by the preset angle.

3. The portable drum-type cashbox according to claim 2, further comprising a photoelectric sensor; wherein the photoelectric sensor is configured to detect the position of the pull rod.

4. The portable drum-type cashbox according to claim 3, wherein, the housing comprises: a left shell, a right shell, a front door, a side door, a door lock, a drum box handle, a banknote passage and a gear; and a toothed edge at one side of the gear is engaged with the small winding drum gear, and a toothed edge at another side of the gear is configured to engage with a transmission gear of an ATM; and the transmission gear of the ATM is configured to match with the gear.

5. The portable drum-type cashbox according to claim 1, further comprising an unlocking rod; wherein the unlocking rod is movably mounted at a mounting point in the housing, and has one end movably connected to the pull rod.

6. The portable drum-type cashbox according to claim 5, wherein, in the case that the unlocking rod is pulled, the unlocking rod rotates about the mounting point by a certain angle, and drives the pull rod to move upwards by a certain distance.

7. The portable drum-type cashbox according to claim 6, further comprising a photoelectric sensor; wherein the photoelectric sensor is configured to detect the position of the pull rod.

8. The portable drum-type cashbox according to claim 7, wherein, the housing comprises: a left shell, a right shell, a front door, a side door, a door lock, a drum box handle, a banknote passage and a gear; and a toothed edge at one side of the gear is engaged with the small winding drum gear, and a toothed edge at another side of the gear is configured to engage with a transmission gear of an ATM; and the transmission gear of the ATM is configured to match with the gear.

9. The portable drum-type cashbox according to claim 5, further comprising a photoelectric sensor; wherein the photoelectric sensor is configured to detect the position of the pull rod.

10. The portable drum-type cashbox according to claim 9, wherein, the housing comprises: a left shell, a right shell, a front door, a side door, a door lock, a drum box handle, a banknote passage and a gear; and a toothed edge at one side of the gear is engaged with the small winding drum gear, and a toothed edge at another side of the gear is configured to engage with a transmission gear of an ATM; and the transmission gear of the ATM is configured to match with the gear.

11. The portable drum-type cashbox according to claim 1, further comprising a photoelectric sensor; wherein the photoelectric sensor is configured to detect the position of the pull rod.

12. The portable drum-type cashbox according to claim 11, wherein, the housing comprises: a left shell, a right shell, a front door, a side door, a door lock, a drum box handle, a banknote passage and a gear; and a toothed edge at one side of the gear is engaged with the small winding drum gear, and a toothed edge at another side of the gear is configured to engage with a transmission gear of an ATM; and the transmission gear of the ATM is configured to match with the gear.

13. An ATM, comprising a cashbox power device and a portable drum-type cashbox; wherein the portable drum-type cashbox comprises a housing; a large winding drum gear, a small winding drum gear, a connecting socket, and a self-locking mechanism;

the self-locking mechanism comprises: an electromagnet, a first spring, a second spring, a first locking rod, a second locking rod, and a pull rod;

the pull rod has an upper end mounted cooperatively with the electromagnet, and a lower end movably connected to the first locking rod;

the first spring has one end fixedly connected to the housing, and another end fixedly connected to the first locking rod;

the second spring has one end fixedly connected to the housing, and another end fixedly connected to the second locking rod;

the first locking rod is connected to the second locking rod via a rotary shaft;

the first locking rod is provided with a toothed portion configured to engage with teeth of the small winding drum gear; and the second locking rod is provided with a toothed portion configured to engage with teeth of the large winding drum gear; and wherein the cashbox power device comprises: a large-winding-drum power motor, a small-winding-drum power motor and a frame;

the large-winding-drum power motor is fixed inside the frame, and is connected to the large winding drum gear of the portable drum-type cashbox via a synchronous belt;

the small-winding-drum power motor is fixed inside the frame, and is configured to engage with a gear of the portable drum-type cashbox via a transmission gear; and the transmission gear is mounted onto the frame.

14. The ATM according to claim 13, further comprising:

a banknote entrance module, an upper-portion upper passage module, an upper-portion lower passage module, a banknote identification module, a lower-portion passage module, a plurality of upper drum-type cashboxes and a plurality of lower drum-type cashboxes; wherein the banknote entrance module is mounted at a position of a banknote entrance of the ATM, and is used for banknote feeding, banknote counting, and banknote dispensing of the ATM;

the upper-portion upper passage module is mounted at an upper portion of the ATM, and is configured to provide a conveying passage for banknotes in an upper side of the upper portion of the ATM;

the upper-portion lower passage module is mounted at the upper portion of the ATM, and is configured to provide a conveying passage for banknotes in a lower side of the upper portion of the ATM;

the banknote identification module is mounted at the upper portion of the ATM, and is configured to identify banknotes and count banknotes;

the lower-portion passage module is mounted at a lower portion of the ATM, and is configured to provide a conveying passage for banknotes in the lower portion of the ATM;

the plurality of upper drum-type cashboxes are mounted at an upper side of the lower portion of the ATM, and are configured to store banknotes; and the plurality of lower drum-type cashboxes are mounted at a lower side of the lower portion of the ATM, and are configured to store banknotes.

15. The ATM according to claim 14, further comprising:

a first reversing mechanism, a second reversing mechanism, and a third reversing mechanism; wherein, the first reversing mechanism is configured to switch a conveying direction of banknotes at a junction of the upper-portion upper passage module, the upper-portion lower passage module, and the lower-portion passage module;

the second reversing mechanism is configured to switch the conveying direction of banknotes at a junction of the upper-portion upper passage module and the upper-portion lower passage module; and the third reversing mechanism is configured to switch the conveying direction of banknotes between passage branches inside the upper-portion upper passage module.

16. The ATM according to claim 15, wherein banknotes in the plurality of upper drum-type cashboxes and/or the plurality of lower drum-type cashboxes are configured to enter into the portable drum-type cashbox with the assistance of the lower-portion passage module, the first reversing mechanism, the banknote identification module, the upper-portion lower passage module, the upper-portion upper passage module, the third reversing mechanism or the second reversing mechanism, to be audited, and to return into the plurality of upper drum-type cashboxes and/or the plurality of lower drum-type cashboxes.

17. The ATM according to claim 13, wherein the first locking rod is movably connected to the second locking rod via the rotary shaft; and in the case that the first locking rod rotates about the rotary shaft by a preset angle, the first locking rod is engaged with the second locking rod; and in the case that the first locking rod rotates about the rotary shaft by two times of the preset angle, the first locking rod drives the second locking rod to rotate about the rotary shaft by the preset angle.

18. The ATM according to claim 13, wherein the portable drum-type cashbox further comprises an unlocking rod; and the unlocking rod is movably mounted at a mounting point in the housing, and has one end movably connected to the pull rod.

19. The ATM according to claim 18, wherein in the case that the unlocking rod is pulled, the unlocking rod rotates about the mounting point by a certain angle, and drives the pull rod to move upwards by a certain distance.

20. The ATM according to claim 13, wherein the portable drum-type cashbox further comprises a photoelectric sensor; and the photoelectric sensor is configured to detect the position of the pull rod.

* * * * *